US005435664A

United States Patent [19]

Pettersson

[11] Patent Number: 5,435,664

[45] Date of Patent: Jul. 25, 1995

[54] SEWAGE WATER PUMPING STATION, AND A TANK THEREFOR

[75] Inventor: Nils-Erik Pettersson, Vasteras, Sweden

[73] Assignee: ITT Flygt AB, Solna, Sweden

[21] Appl. No.: 183,684

[22] Filed: Jan. 19, 1994

[30] Foreign Application Priority Data

Feb. 11, 1993 [SE] Sweden ..... 9300444

[51] Int. Cl.[6] ..... E02B 13/00; C02F 1/00

[52] U.S. Cl. ..... 405/52; 210/104; 210/171; 405/128; 417/360

[58] Field of Search ..... 405/52, 79, 303; 366/190, 184, 262, 263; 210/104, 171; 417/360

[56] References Cited

U.S. PATENT DOCUMENTS

| | | | |
|---|---|---|---|
| 345,868 | 7/1886 | Spencer | 366/190 X |
| 2,118,951 | 5/1938 | Stienen | 68/190 X |
| 2,209,143 | 7/1940 | Tolman | 366/184 X |
| 2,342,559 | 2/1944 | Sebald et al. | 366/184 X |
| 2,685,986 | 8/1954 | Hampton | 366/184 X |
| 3,642,134 | 2/1972 | Reckers | 210/104 X |
| 4,594,153 | 6/1986 | Weis | 210/171 X |
| 4,661,047 | 4/1987 | Weiss . | |
| 4,808,040 | 2/1989 | Lisi | 405/303 |
| 5,256,281 | 10/1993 | Ngo et al. | 405/52 X |

FOREIGN PATENT DOCUMENTS

| | | |
|---|---|---|
| 0193137 | 9/1986 | European Pat. Off. . |
| 3333883 | 3/1985 | Germany . |
| 3335435 | 4/1985 | Germany . |
| 3542529 | 6/1987 | Germany . |

*Primary Examiner*—Dennis L. Taylor
*Attorney, Agent, or Firm*—Menotti J. Lombardi

[57] ABSTRACT

The tank has vertical walls joined to a horizontal bottom with a diagonal wall bridging between an intermediate portion of one of the vertical walls and the bottom. The diagonal wall has an access opening formed therein, and it cooperates with the one vertical wall and the bottom to form a sheltering recess, in the tank, for pumping station components. The pumping station has the relevant components emplaced in the tank, and sewage water admitting and discharging facility, with a submersible pump and water-handling piping. Station components, and portions thereof, are sheltered in the recess of the tank, to accommodate an optimum water flow in the tank, and to minimize an entanglement of solid objects with the components.

4 Claims, 2 Drawing Sheets

SEWAGE WATER PUMPING STATION, AND A TANK THEREFOR

BACKGROUND OF THE INVENTION

This invention relates, generally, to sewage water pumping stations, and tanks therefor, and in particular to improvements thereof for inhibiting clogging of the pump by sludge banks and/or solid bodies.

Pumping stations of the type with which this invention is concerned are provided with one or more inlets for the sewage water and normally one outlet pipe, the latter being in communication with the pump outlet or discharge. An example of such is disclosed in Swedish Patent No. 366,013, and its corresponding U.S. Pat. No. 3,957,633, issued on May 18, 1976, to Giuliano Gatti, et al, for a Sewage Treatment Method and Apparatus.

In typical prior art, a submersible pump unit, comprising the sewage water pump, is normally lowered into the sewage water, confined within the pumping station tank, along guides. It is so arranged that the pump unit, in its fully lowered position, aligns its outlet with the outlet pipe within the station tank. The pump unit must seal against the outlet pipe of the station tank without any bolting or fasteners of any kind. For this purpose, a so-called connection support is arranged at the bottom of the station tank, and is provided with a pipe part, attached to the outlet pipe at one end, and having a flange at the opposite end. A corresponding flange on the pump contactingly aligns with the connection support flange. Lowermost ends of the guides are coupled to the connection support.

Sewage water contains a lot of solid bodies, such as sludge, which are readily agglomerated on the tank bottom as sludge banks, rags and other, elongated objects. Such may wind around the pump unit and its connecting parts. Too, sludge banks and rags are a hindrance to the circulation within the tank, and my also clog the pump inlet.

It is a known practice, to solve the problem with the sludge banks in the tank, by means of intermittingly-operating, mixing devices of the type shown in the Swedish Patent No. 8900 597-9, and its corresponding U.S. Pat. No. 4,948,342. Another method, drawn to the same purpose, is to install machines or devices which keep the sewage water moving within the tank.

Yet another method which is used to prevent sludge from collecting at the bottom of the tank is to design the bottom with steep slopes, and then arrange the pump inlet at the lowest point in the tank. However, even here, there remains the problem that elongated objects stick to the guides, the connection supports for the pump, and related, pump unit connecting parts.

SUMMARY OF THE INVENTION

It is an object of this invention to disclose a sewage water pumping station, and a tank therefor, which minimizes the sludge collection at the bottom of the tank, and inhibits the intrusion of elongated objects into the connection support for the pump, pump unit connecting parts, and the guides.

Particularly, it is an object of this invention to set forth a tank, for a sewage water pumping station, comprising substantially vertical walls; a substantially horizontal bottom; and at least one diagonal wall, having upper and lower ends; wherein said upper end is joined to one of said vertical walls, and said lower end is joined to said bottom; said diagonal wall has an opening formed therein; said one vertical wall, said bottom, and said diagonal wall cooperatively define means for forming a recess within said tank; and said opening comprises an access to said recess.

It is also an object of this invention to disclose a sewage water pumping station, comprising a tank having(a) substantially vertical walls, (b) a substantially horizontal bottom, and (c) at least one diagonal wall, having upper and lower ends; wherein said upper end is joined to one of said vertical walls, and said lower end is joined to said bottom; said diagonal wall has an opening formed therein; said one vertical wall, said bottom and said diagonal wall cooperatively define means for forming a recess within said tank; at least one submersible pump confined within said tank; connection support means (a) aligned with said pump, and (b) confined within said recess; means formed in one of said vertical and diagonal walls for admitting sewage water into said tank; and means in communication with said pump for discharging sewage water from said tank.

Further objects of this invention as well as the novel features thereof, will be apparent by reference to the following description, taken in conjunction with the accompanying figure.

DESCRIPTION OF THE PREFERRED EMBODIMENTS

Figure 1:
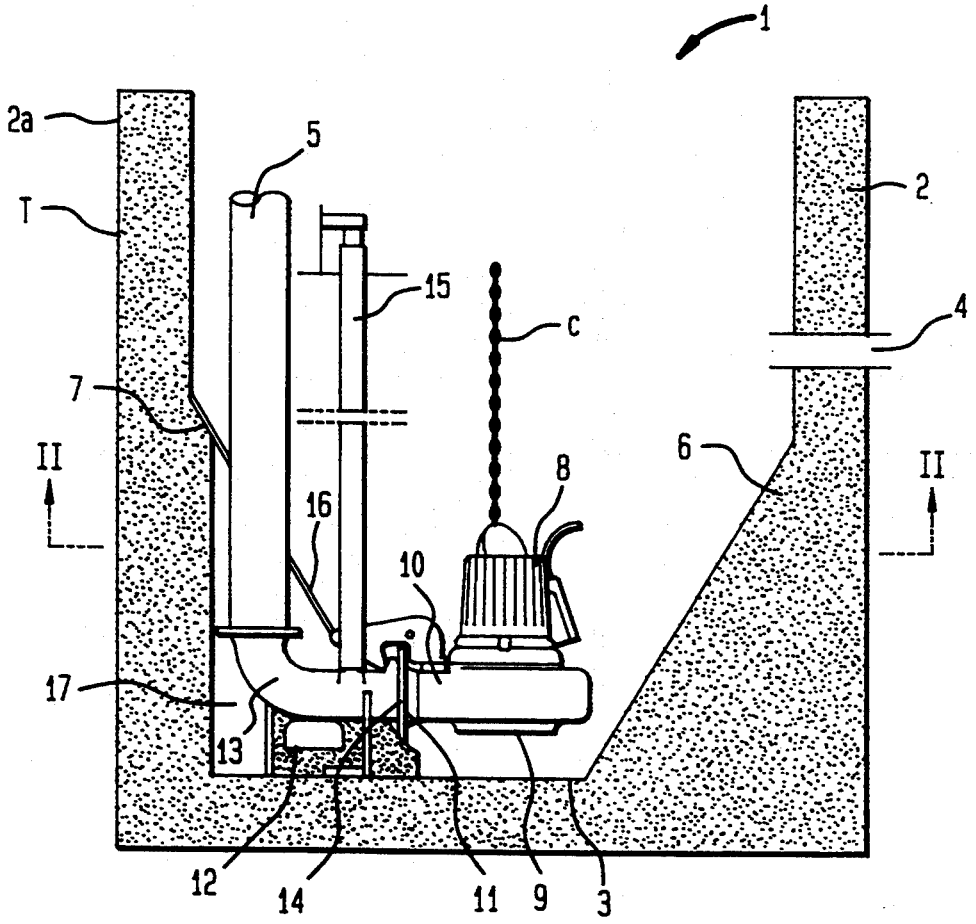
FIG. 1 is a vertical, cross-sectional view, taken through the tank, according to an embodiment of the invention, showing the novel sewage water pumping station, also according to an embodiment of the invention
Figure 2:
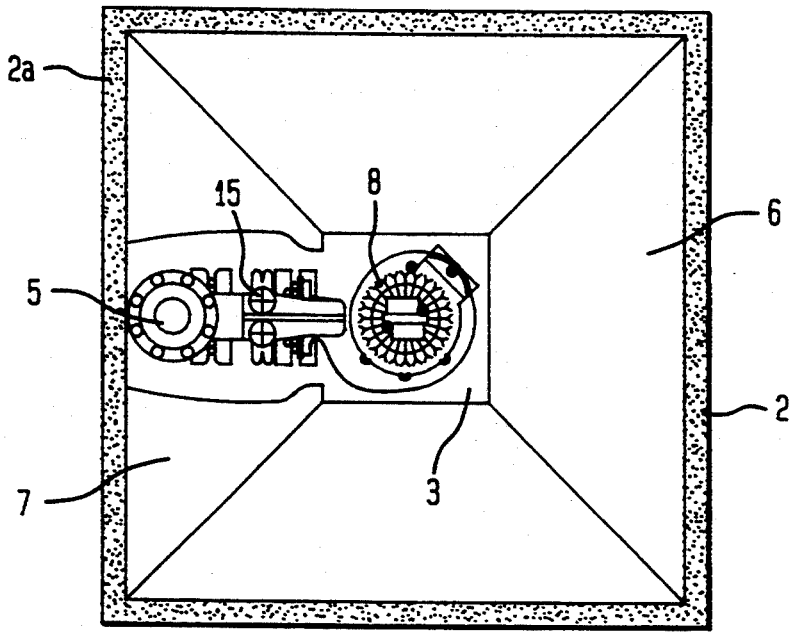
FIG. 2 is a top view of FIG. 1 taken along line II—II.

As shown in the figure, the novel sewage water pumping station 1, comprises a tank "T" having vertical walls 2 and 2*a*, and a horizontal bottom 3. An opening 4, formed through wall 2, comprises an inlet for sewage water into the tank "T". An outlet pipe 5 comprises the means for discharging sewage water from the tank "T". Diagonal walls 6 and 7 are joined to the vertical walls 2 and 2*a*, respectively, at upper ends thereof, and to the bottom 3, at lower ends thereof. Wall 6 is formed of concrete, whereas wall 7 is formed of sheet metal. A submersible pump 8 is confined within the tank "T"; it has an inlet 9, and an outlet 10. The outlet 10 has a flange 11 for mating with a connection support 12 which is fastened to the bottom 3 of the tank. The connection support 12 has a pipe 13 which aligns with the outlet pipe 5, and has a flange 14 which interfaces and aligns with the flange 11. Longitudinal guides 15 (only one is shown) have innermost ends thereof removably coupled to the connection support 12 by means of annuluses formed on the connection support 12.

The pumping station 1 is fed sewage water through the opening 4, and the water leaves the tank "T" through the pipe 5. The pumping is provided by the submersible pump 8 via the inlet 9 and outlet 10 thereof.

In order to minimize the agglomeration of sludge banks in the bottom of the tank "T" the diagonal walls 6 and 7 are provided As can be seen, the inlet 9 for the pump 8 is located whereat the inner ends of the walls 6 and 7 approach convergence, and where most of the solid bodies will collect.

The pump 8 is lowered down to the bottom of the tank "T" along the guides 15 (and in this embodiment two guides are employed, albeit only one is shown). The guides 15 so position the outlet 10 of the pump 8 that its flange 11 interfaces and aligns with the flange 14 of the pipe 13. The alignment and dimensioning are such that there is no need for the two flanges 11 and 14 to be fastened together, and the pump outlet 10, nonetheless, is sealingly in communication with the pipe 13 and, concomitantly, with the pipe 5. Due to this arrangement, the pump 8 can be easily hoisted, up along the guides 15, by the chain "C" for maintenance or replacement.

As previously mentioned, it often happens that elongated objects, rags, and the like, get intrusively entangled with connecting and/or projecting parts of the the tank-confined components. According to a feature of the invention, the connection support 12, a part of the outlet pipe 5 and the lowermost end of the guides 15 are shielded, substantially, from the aforesaid objects, rags, and such. Wall 7 has an opening 16 formed therein to accommodate the pipe 5, connection support 12 and guides 15. Wall 7, in cooperation with wall 2*a*, and bottom 3 defines a recess 17 in which to house the innermost end of pipe 5, the pipe 13, substantially all of the connection support 12 and the innermost, or lowermost ends of the guides 15. In this way, the number of projecting parts within the tank "T" exposed to the troublesome solids in the sewage water are considerably diminished. This provides for a better flow of the sewage water within the tank "T" and inhibits the agglomeration of elongated fibers, rags and other solids.

As previously noted, the wall 7 is formed of sheet metal. Alternatively, however, this diagonal wall could be formed of concrete providing that, in the forming thereof, a suitable recess, such as recess 17, is formed therein during the casting. The use of sheet metal, of course, makes it readily feasible to modify existing pumping stations for the benefits of this invention. In either case, i.e., where the recess 17 is formed by means of an opening in a sheet metal wall or concrete wall, a suitable cover (not shown) can be positioned over those portions of the opening 16 which are not penetrated by the pipe 5, guides 15, and connection support 12. It can be arranged for such cover to be emplaced, after the mounting of the connection support 12 and the pump 8, and for the cover to accompany the pump 8 when the latter is hoisted out for maintenance and/or replacement.

The pump 8, as can be seen, is positioned so that its inlet 9 is close to the bottom 3 of the tank "T", and in proximate adjacency to the lower end of the diagonal wall 7. Inlet 9, in fact, is sited whereat the walls 6 and 7 approach their convergence. Accordingly, the inlet 9 is located where heavy objects tend to collect and, therefore, can readily be pumped out; thus the problem of agglomerating sludge banks is substantially eliminated. The slope of the walls 6 and 7, to yield the desired effect, is between approximately forty to sixty degrees of arc with reference to the horizontal plane.

Further, to minimize the likelihood that sludge banks and solids will impede water flow in the tank "T" and/or collect about the guides 15, it is arranged that, after the connection support 12 and pump 8 are positioned in the tank "T", the guides 15 can be removed. They are wholly removed from the tank "T", until they have to be used again for removal of the pump 8 for maintenance or replacement, by slidably extracting them from the connection support 12.

While I have described my invention, in connection with specific embodiments thereof, it is to be clearly understood that this is done only by way of example, and not as a limitation to the scope of the invention, as set forth in the objects thereof, and in the appended claims.

I claim:

1. In a sewage pumping station comprising a tank (T) having substantially vertical walls (2, 2*a*), a substantially horizontal bottom (3), an inlet (4) in one of said walls, an outlet pipe (15), a submersible pump (8) with a flange (11) a connection pipe (13) having a flange (14) for connecting to flange (11) and being coupled to outlet pipe (5), a connecting support (12) connected between the pipe (13) and the bottom (3) of the tank (T), a longitudinal guide (15) being coupled to the connection pipe (13) and the pump (8) to guide the pump (8) during lowering to and raising from the bottom (3) of tank (T), the improvement comprising:

diagonal walls (6, 7) having upper and lower ends, the upper end of one diagonal wall (6) being joined to the vertical wall (2) and the lower end being joined to the bottom (3), the upper end of the other diagonal wall (7) being joined to the vertical wall (2*a*) and the lower end being joined to the bottom (3), said vertical wall (2), said bottom (3), and said diagonal wall (7) cooperatively define a recess (17) within said tank (T), a part of said pipe (5), said connecting pipe (13) and said connecting support (12) being located within said recess (17) to effect better flow of sewage water within the tank (T), and the inlet of said pump (8) being located whereat the lower ends of the walls (6, 7) approach convergence.

2. The pumping station according to claim 1, wherein the diagonal wall (7) is made of sheet metal, and has an opening to accommodate said pipe (15), said connecting pipe (13) and support (12).

3. The pumping station according to claim 1 wherein the diagonal wall (6) is made of concrete.

4. The pumping station according to claim 1 wherein the diagonal walls (6, 7) have a slope of 40 to 60 degrees with respect to the bottom (3).

* * * * *